United States Patent [19]

Reynoir et al.

[11] 4,294,331

[45] Oct. 13, 1981

[54] METHOD AND SYSTEM FOR ESCAPING FROM AN OFFSHORE DRILLING PLATFORM

[75] Inventors: Ronald H. Reynoir; Robert A. Flautt, both of New Orleans, La.; Clyde M. Leavitt, Ocean Springs, Miss.

[73] Assignee: The Reynoir Company, New Orleans, La.

[21] Appl. No.: 102,934

[22] Filed: Dec. 12, 1979

[51] Int. Cl.[3] ..... A62B 1/02; B63C 9/02

[52] U.S. Cl. ..... 182/10; 182/191; 114/264; 114/293; 9/14

[58] Field of Search ..... 182/10, 191, 192, 193; 114/293, 264, 265; 9/14

[56] References Cited

U.S. PATENT DOCUMENTS

| | | | |
|---|---|---|---|
| 494,090 | 3/1893 | Stevens | 9/14 |
| 636,605 | 11/1899 | Wilson | 182/10 |
| 647,449 | 4/1900 | Johnston | 9/14 |
| 807,802 | 12/1905 | Auld | 9/14 |
| 870,089 | 11/1907 | Ellis | 182/10 |
| 3,076,205 | 2/1963 | Schultz | 114/264 |
| 3,796,281 | 3/1974 | Dowling | 182/191 |
| 3,826,335 | 7/1974 | Allen | 182/10 |
| 3,880,254 | 4/1975 | Fitzgerald | 182/10 |
| 4,056,167 | 11/1977 | Bonafos | 182/10 |
| 4,122,917 | 10/1978 | Kendrick | 182/10 |
| 4,167,147 | 9/1979 | Bergman | 114/265 |
| 4,203,504 | 5/1980 | Reynoir | 182/10 |
| 4,231,313 | 11/1980 | Heerema | 114/265 |

*Primary Examiner*—Reinaldo P. Machado

*Attorney, Agent, or Firm*—Cushman, Darby & Cushman

[57] ABSTRACT

Improvements in a system for escaping from an offshore drilling or production platform in an emergency situation which includes a stable floating structure forming a safe haven anchored near but at a safe distance from the platform, an aerial cableway extending between the platform and the haven, and a personnel carrier movable along the cableway. The principal improvement is that the haven is a semi-submersible structure for increased stability.

17 Claims, 20 Drawing Figures

METHOD AND SYSTEM FOR ESCAPING FROM AN OFFSHORE DRILLING PLATFORM

BACKGROUND OF THE INVENTION

This invention relates to improvements in the invention disclosed in our copending application, Ser. No. 951,460, filed Oct. 16, 1978, for Method And System For Escaping From An Offshore Drilling Platform, the disclosure of which is incorporated by reference herein. There is disclosed in that application an improved system for evacuating personnel in emergency situations, such as a fire, from offshore platforms engaged in hazardous operations involving explosive and combustible fluids, e.g., oil and gas, entrapped in the marine bottom, such as drilling rigs, production platforms, work over platforms, or the like. The system includes a buoyant floating haven anchored in a relatively fixed position near, but at a safe distance from, the platform, a downwardly inclined cableway extending above water from the platform to the haven and a personnel carrier suspended on the cableway for transporting personnel from the platform to the haven.

While the system disclosed in said application is most satisfactory for its intended purpose, improvements are possible and desirable. Thus, the haven shown and described in said application is in the form of a self-propelled vessel, namely, a catamaran. Such a vessel, however, not only is expensive but also subject to some degree of pitching and rolling in rough seas. Further the cableway shown and described in said application is in the form of two parallel cables properly tensioned by appropriate means carried on the haven. While a two-cable cableway provides increased stability for a personnel carrier, it is more expensive than a single cable and, further, it is difficult to maintain the same tension in both cables of a two-cable cableway. Without the same tension, one cable will sag below the other with consequent undesirable leaning of the carrier. Additionally, the provision of means on the haven for tensioning the cableway is unnecessary in most installations because suitable tensioning means usually are readily available on the platform.

While the carrier disclosed in said application is there described as buoyant, the entire system is intended to have the carrier land on the haven. Such a landing requires the cableway lower end to be at a relatively high elevation above water. Such a high elevation requires a relatively large haven in order to provide the necessary support for the lower end of the cableway.

SUMMARY OF THE INVENTION

Accordingly, it is a principal object of this invention to provide a haven for use in the aforedescribed system which is less expensive and more stable than a self-propelled vessel.

It is another object of this invention to provide a cableway for use in the above-described system that is of less expensive construction and which utilizes means normally available on an offshore platform for tensioning such cableway.

It is another object of this invention to provide an improved system of the type under consideration wherein the carrier may land in the water near the haven and means are provided for moving the carrier to the haven while in the water, thus permitted use of a haven of smaller size and less expensive construction that one wherein the carrier lands thereon.

The principal object of the invention is accomplished by constructing the haven with one or more upright ballastable cylinders having enlarged compartments at their upper ends which are partially submerged when the haven is in its operative position. Other objects are accomplished by the use of single-cable cableways, a buoyant carrier having a water-tight cabin, and an outboard motor carried by the carrier for attachment to the latter to propel it in the water.

Other objects and advantages will become apparent from the following description and accompanying drawings in which:

BRIEF DESCRIPTION OF THE DRAWINGS

FIG. 14 is a plan view of the haven shown in FIG. 13.

DETAILED DESCRIPTION OF THE INVENTION

Figure 1:
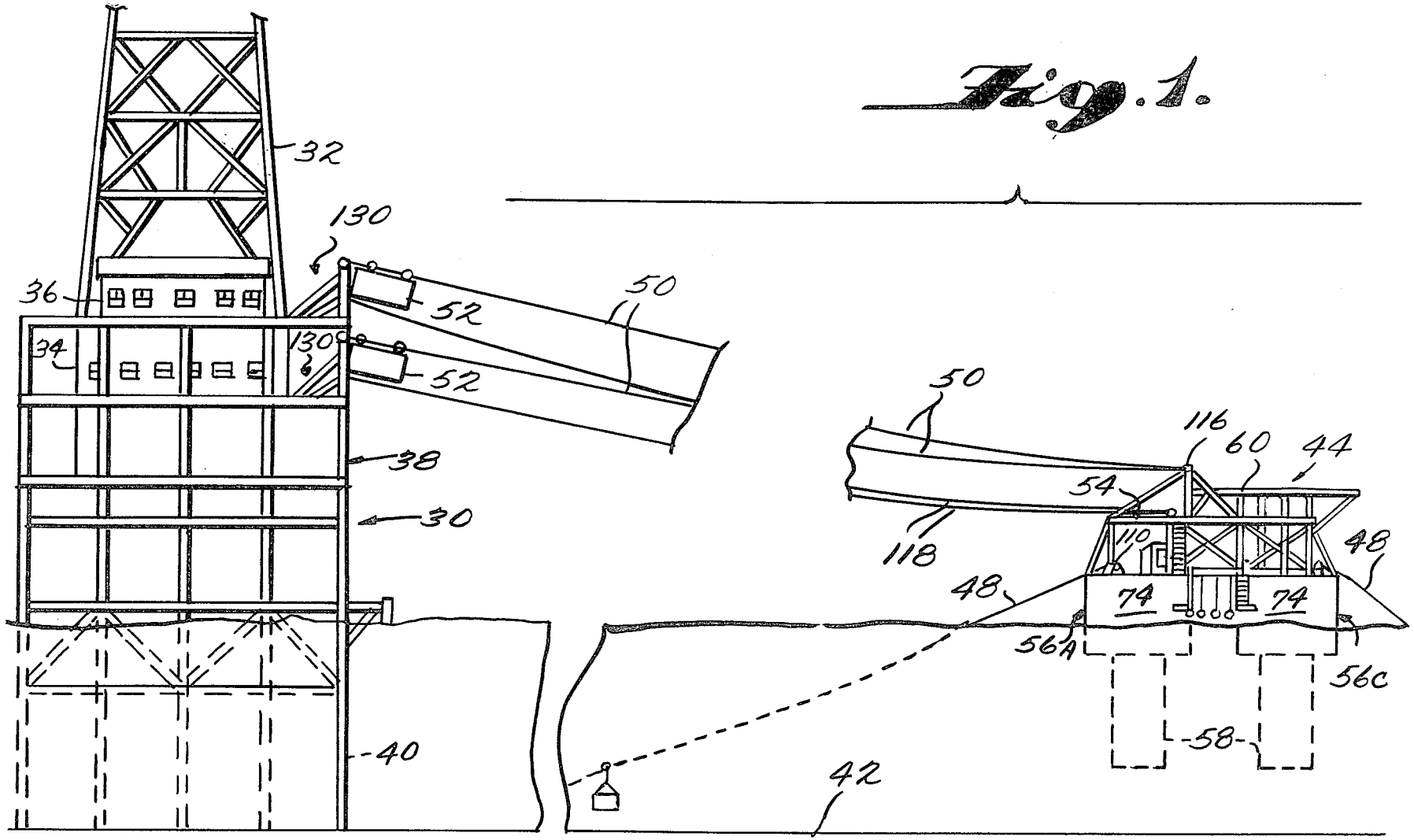
FIG. 1 is an elevational view of an improved system embodying this invention.
Figure 2:
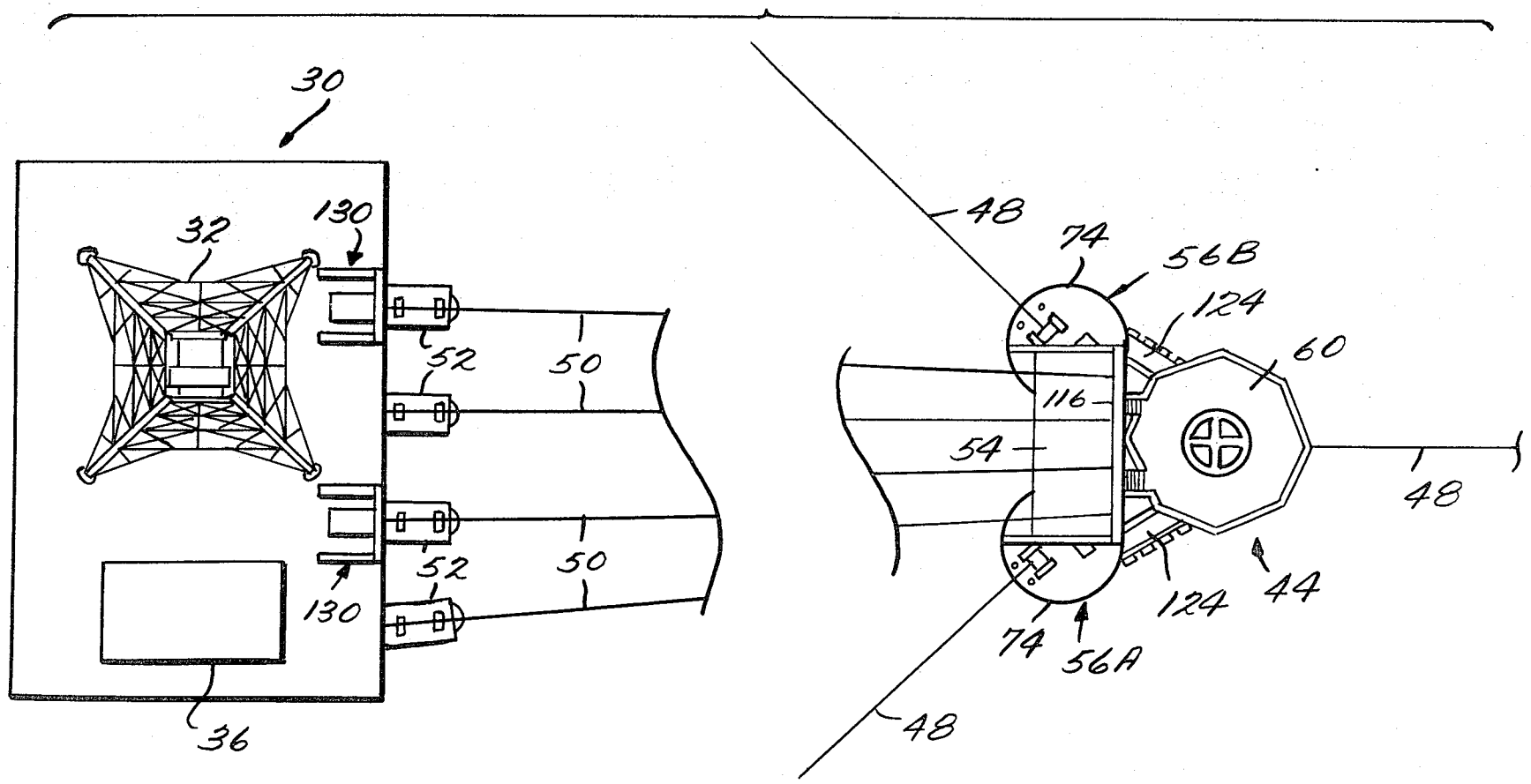
FIG. 2 is a plan view of the system shown in FIG. 1.
Figure 3:
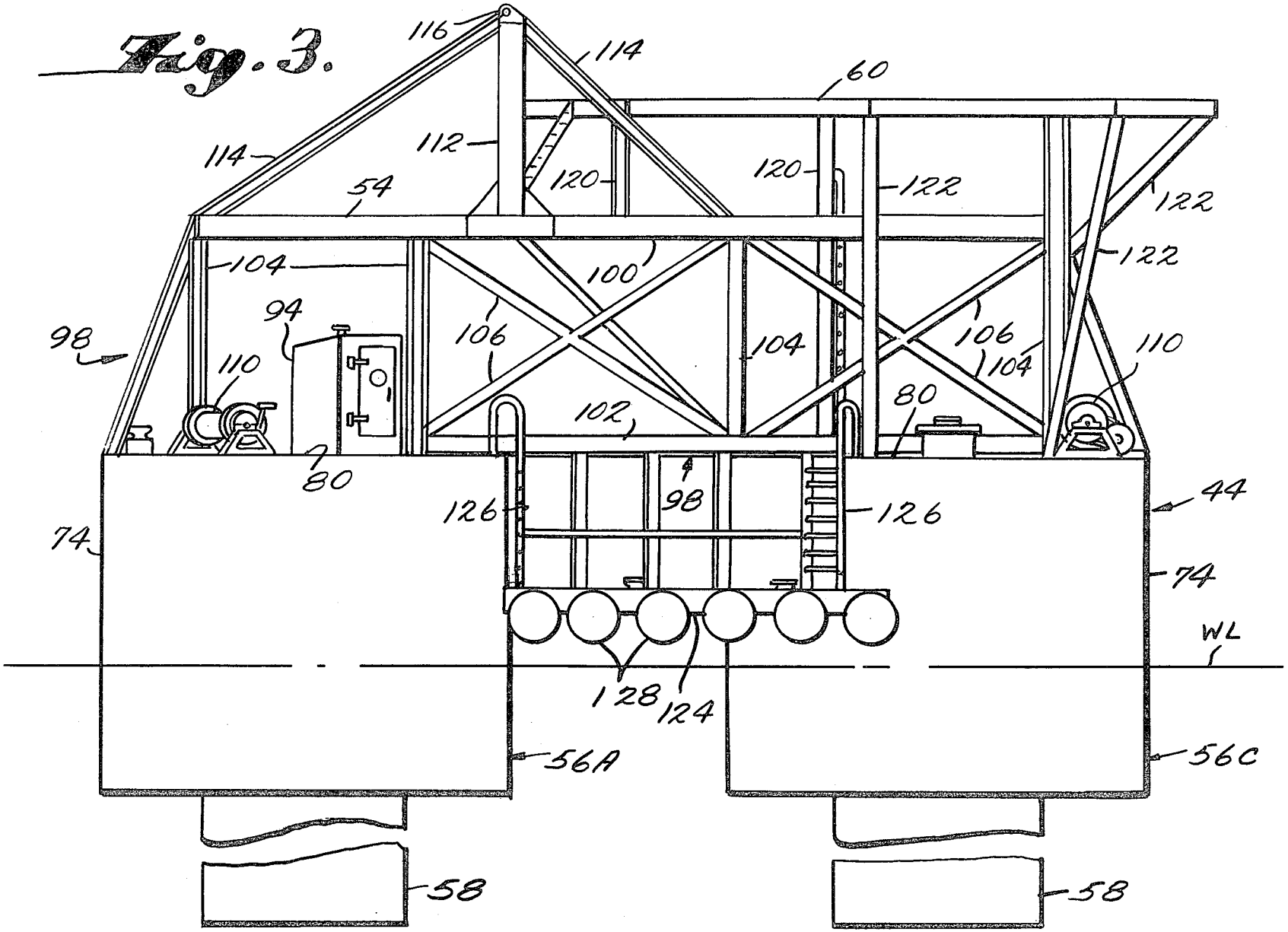
FIG. 3 is an enlarged view of the haven shown in FIG. 1.

Referring now to FIGS. 1–5 of the drawing, there is shown a system for swiftly and quickly evacuating personnel from an offshore platform 30 in the event of a hazardous condition, which system embodies some of the improvements provided by this invention. The platform 30 is illustrated as being of the fixed drilling rig type having a drilling derrick 32, personnel quarters 34 and a machinery house 36 carried on an above-water superstructure 38 on top of supporting legs 40 imbedded in the marine bottom 42. The system is applicable, however, to any of the well-known types of mobile offshore platforms, e.g., jack-up, semi-submersible, and drill ship. Located near the platform 30 but at a safe distance therefrom is a stable floating haven 44 substantially fixed in position relative to the platform by a plurality of anchors (not shown) and mooring lines 48. Three such anchors and lines 48 are illustrated in FIGS. 1 and 2, but it will be realized that any appropriate number of such anchors and lines may be employed. A plurality of cableways 50, each traversable by a personnel carrier 52 suspended therefrom, extend downwardly from the platform 30 to a landing deck 54 on the haven 44, four such cableways being shown in FIGS. 1 and 2.

Figure 4:
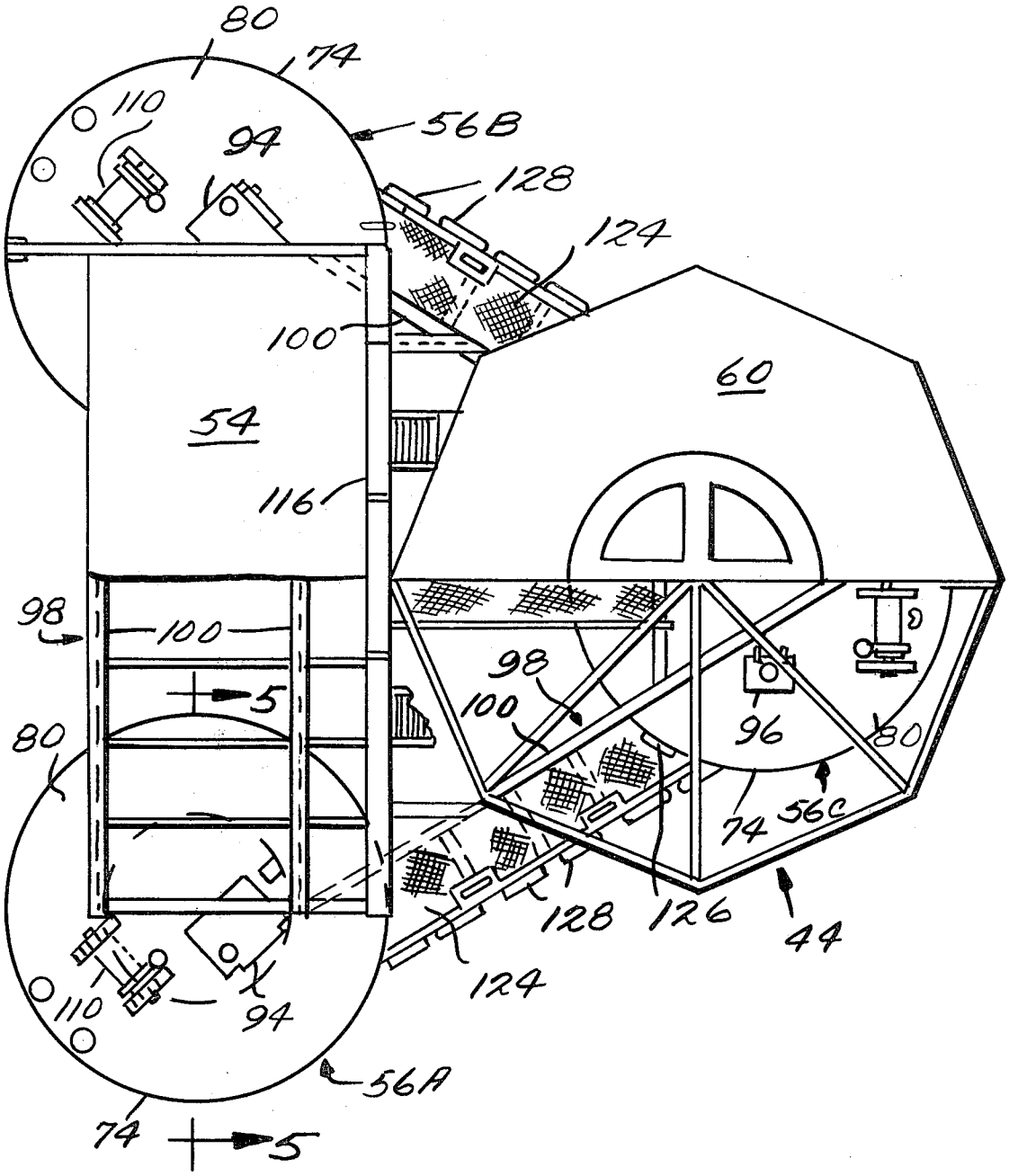
FIG. 4 is a plan view of the haven shown in FIG. 3 with parts omitted to show details.
Figure 5:
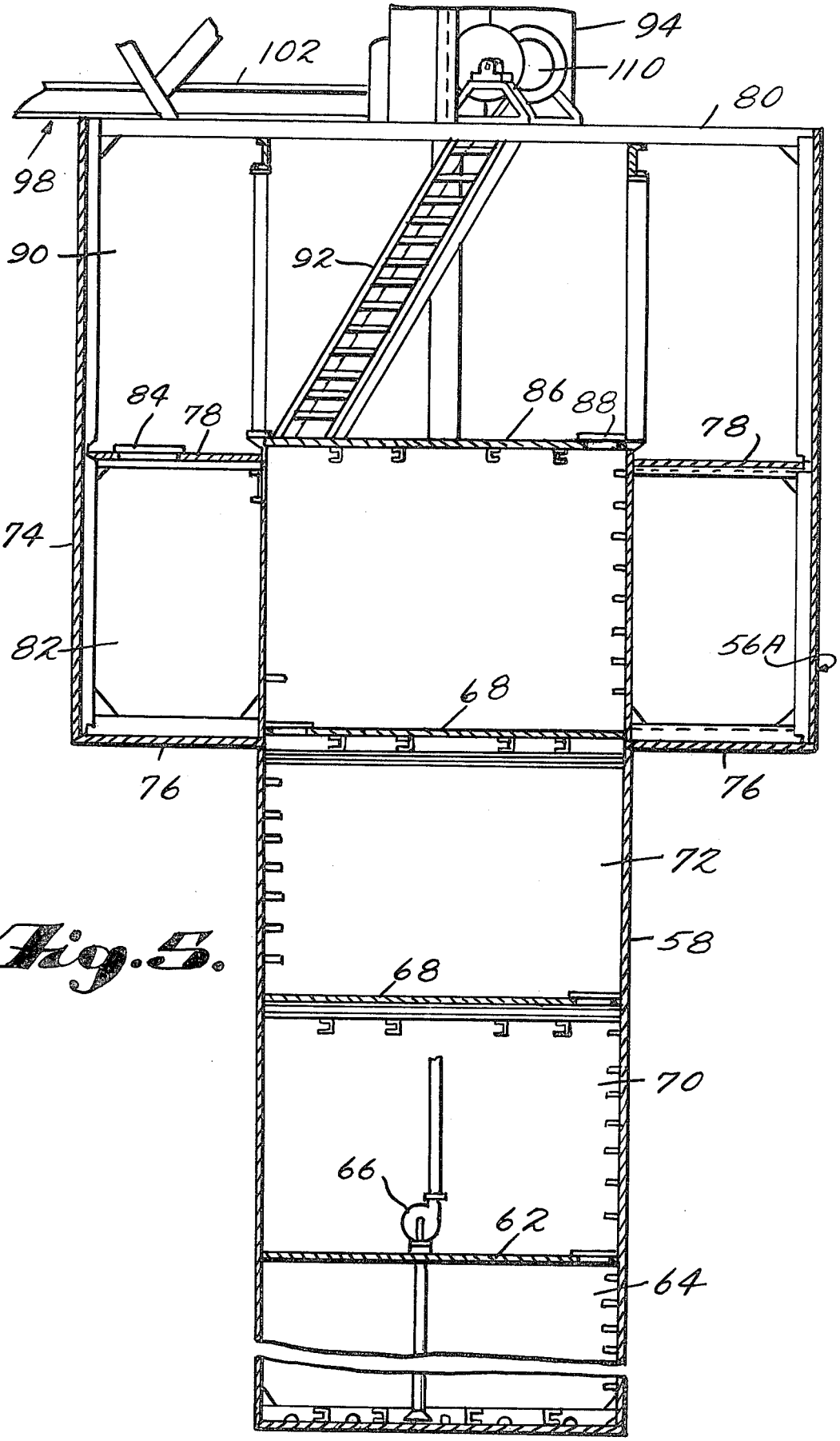
FIG. 5 is an enlarged fragmentary vertical sectional view of the haven shown in FIG. 3 taken on line 5—5 of FIG. 4.

Stability in rough seas is one of the main requisites for the haven 44, as well as being large enough to support the outboard ends of the cableways 50 while maintaining construction cost at a minimum. These requisites are fulfilled admirably by ballastable structures 56 based upon upright cylinders 58. For a haven 44 of the size illustrated in FIGS. 1–5 which has a helicoptor platform 60 and a carrier landing deck 54 that can accommodate four personnel carriers 52 each capable of carrying about 24 people, three such ballastable structures 56, A, B and C are employed. Since the construction of all the structures 56 for the haven 44 are substantially the same, a description of one will suffice for all. Each structure 56 includes an upright buoyant cylinder 58 which, for example, may be of the order of 12 feet in diameter and 35 feet in length or height. Within and spaced above the lower end of the cylinder 58 is a water-tight deck 62 which forms a ballast tank 64 therebelow, as shown in FIG. 5. Appropriate sea valves (not shown) are provided to admit water to the tank 64 along with an appropriate pump 66 to dewater the tank. The cylinder 58 may have a number of other vertically spaced decks 68, e.g. grating with hatches therein, to provide stacked compartments 70, 72 usable for various purposes.

The upper end portion, which may be about 8 feet in height, of the cylinder 58 is enclosed coaxially in an enlarged water-tight cylinder 74, for example, of the order of 24 feet in diameter, and 20 feet in height. The enlarged cylinder 74 is sealed and secured at its lower end to the smaller cylinder by an annular plate 76, and also to the upper end of the inner cylinder 58 by another annular plate 78. The enlarged cylinder 74 extends above the upper end of the inner cylinder 58 and has a weather tight top forming a weather deck 80. The two cylinders 58 and 74 together form a structure 56 which is ballastable to partly submerge the larger cylinder 74 to the waterline indicated in FIGS. 1 and 3 so as to have about 13 feet of freeboard. When so ballasted, the structure 56 is extremely stable in heavy seas, an almost essential attribute for a haven employed in the escape system embodying our invention.

The cylinders 58 and 74 and plates 76 and 78 in the structure 56 form an annular water-tight compartment 82 (FIG. 5) accessible by a manhole having a cover 84 in the upper plate 78, while the top of the inner cylinder is provided with a deck 86, that may be grating provided with a hatch 88, so that the space above the deck 86 and the plate 78 forms another compartment 90 suitable for housing various types of machinery and equipment, e.g., motors, generators, pumps, batteries, fuel tanks, etc. A ladder 92 may provide access to the compartment 90 either from a booby hatch 94 on the weather deck 80 or a manhole therein having a cover 96 (FIG. 4).

The three structures 56 are disposed in generally equi-spaced relation, so that they are each spaced about 18 feet apart, and rigidly connected together by trusswork 98 extending across and fastened to the weather decks 8. As shown, the trusswork 98 includes upper and lower horizontal beams 100, 102, uprights 104, and cross-beams 106. The three structures 56 thus rigidly interconnected form the haven 44, which when ballasted as aforesaid to partially submerge the larger cylinders 74, is extremely stable and not subject to extensive rocking, pitching or up and down movements in rough seas.

On the weather deck 80 of each structure 56 is a winch 110 on which is wound a mooring line 48 having an anchor (not shown) fastened to the end thereof. In operative position the anchors are engaged with the marine bottom 42 at an appropriate distance from the haven 44 and the winches 110 tighten the lines 48 to maintain the haven 44 in a position substantially fixed relative to the marine bottom and oriented so that structure 56C is on the side of the haven away from the platform.

Supported on the upper beams of the trusswork 100 connecting the ballastable structures 56A and 56B which face the platform 30 is plating forming the deck 54 for landing the personnel carriers 52 from the platform 30. To accommodate four carriers 52, each about 9 feet wide, the deck 54 desirably is about 42 feet long. Supported about 12 feet above the aft end of the deck 54, by uprights 112 and braced by inclined members 114, is a horizontal cableway-anchoring beam 116. The lower haven ends of the four cableways 50, each comprising a single cable, are fastened to the beam 116 as shown in FIGS. 1 and 2, while the haven ends of the outhaul lines 118 of the carriers 52 may be secured to the aft edge of the landing deck 54. Desirably the haven 44 has a helicopter platform 60 supported to the rear and above the landing deck 54, by uprights 120 and braces 122.

Preferably, walkways 124, accessible by ladders 126 on the sides of the structures 56, extend between the structures 56A and 56C, and 56B and 56C, below the weatherdecks 80 but above the water line, to form boat landings having bumpers 128.

Figure 7:
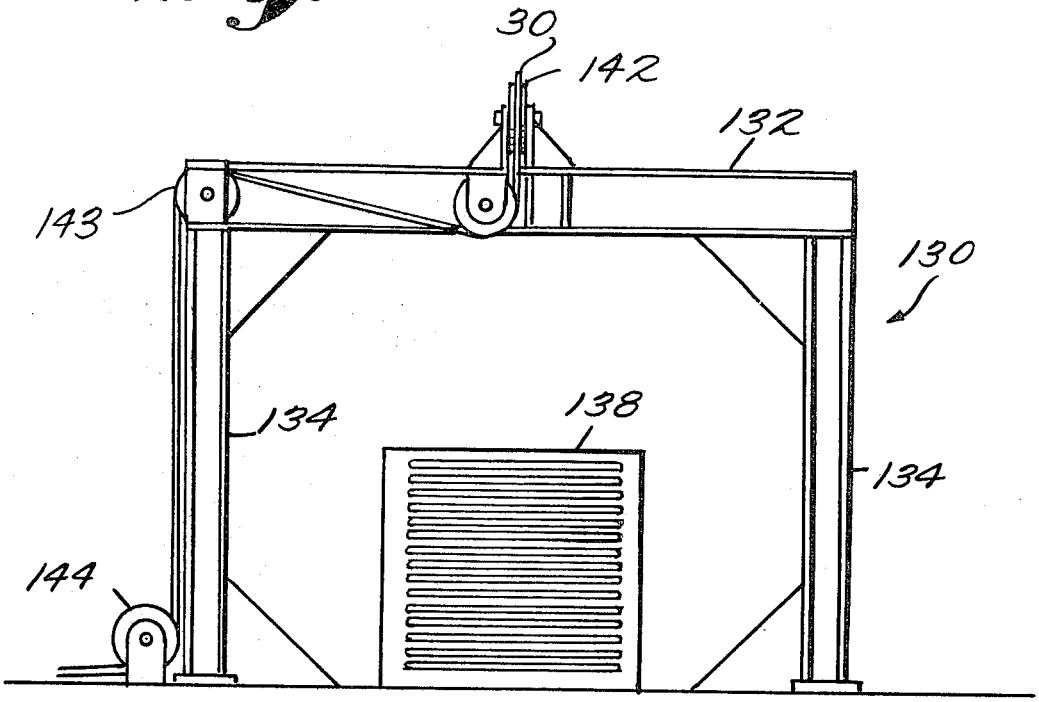
FIG. 7 is a view of the station shown in FIG. 6 taken from the left side thereof.
Figure 6:
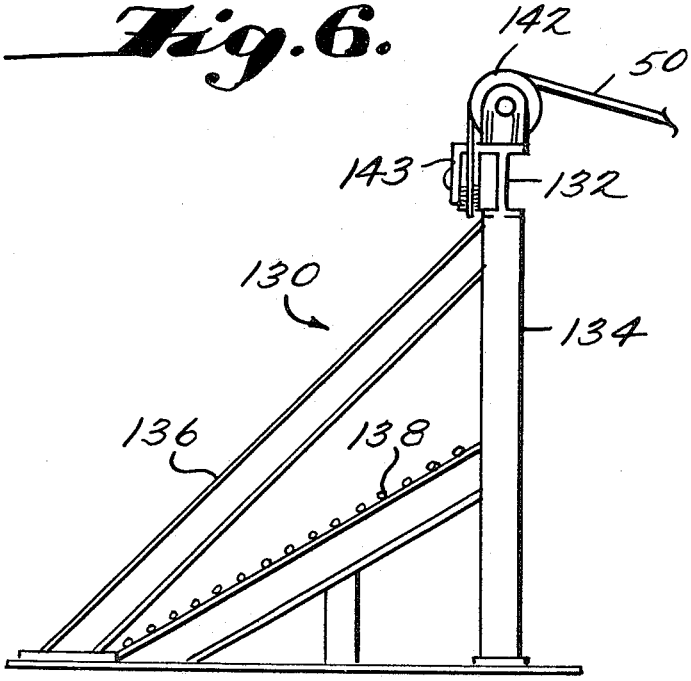
FIG. 6 is an enlarged fragmentary view of one of the platform stations shown in FIG. 1.

In order to avoid the necessity of providing extra equipment on the haven 44, the cableways 50, each comprising a single cable, are each tensioned by suitable equipment on the platform 30. For this purpose, as best shown in FIGS. 6 and 7, each carrier station 130 on the platform 30 includes an elevated horizontal beam 132, supported by uprights 134 and inclined braces 136. An inclined walkway 138 leads from the deck of the platform 30 to the entrance doorway 140 of a personnel carrier 52 when the latter is at the station 130. The cable of the cableway 50 is trained over a sheave 142 mounted on the beam 132, over transversely journalled sheave 143, down to a sheave 144 mounted on the deck of the platform 30, and thence to appropriate means (not shown) for tensioning the cable. Such tensioning means may comprise instrumentalities usually carried on a drilling or production platform, such as a crane, a winch mounted on the deck of the platform or a compressed-air-operated tugger (none of which are shown).

Figure 10:
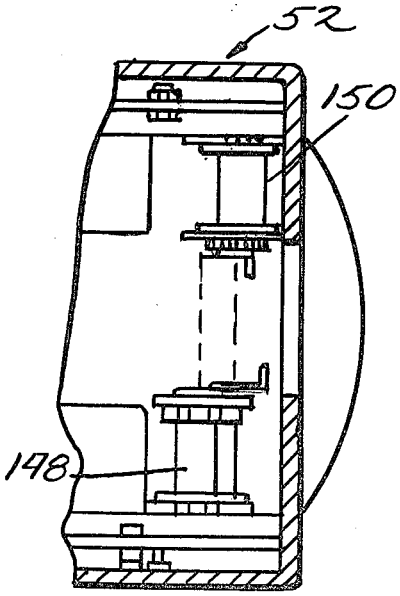
FIG. 10 is a fragmentary horizontal sectional view taken on line 10—10 of FIG. 9.
Figure 8:
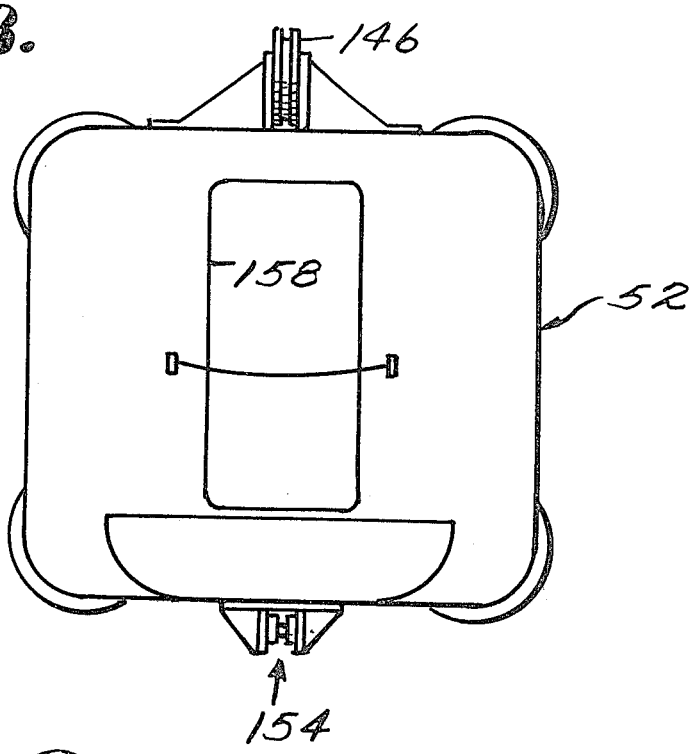
FIG. 8 is an elevational view of the haven and of a personnel carrier embodying this invention.
Figure 9:
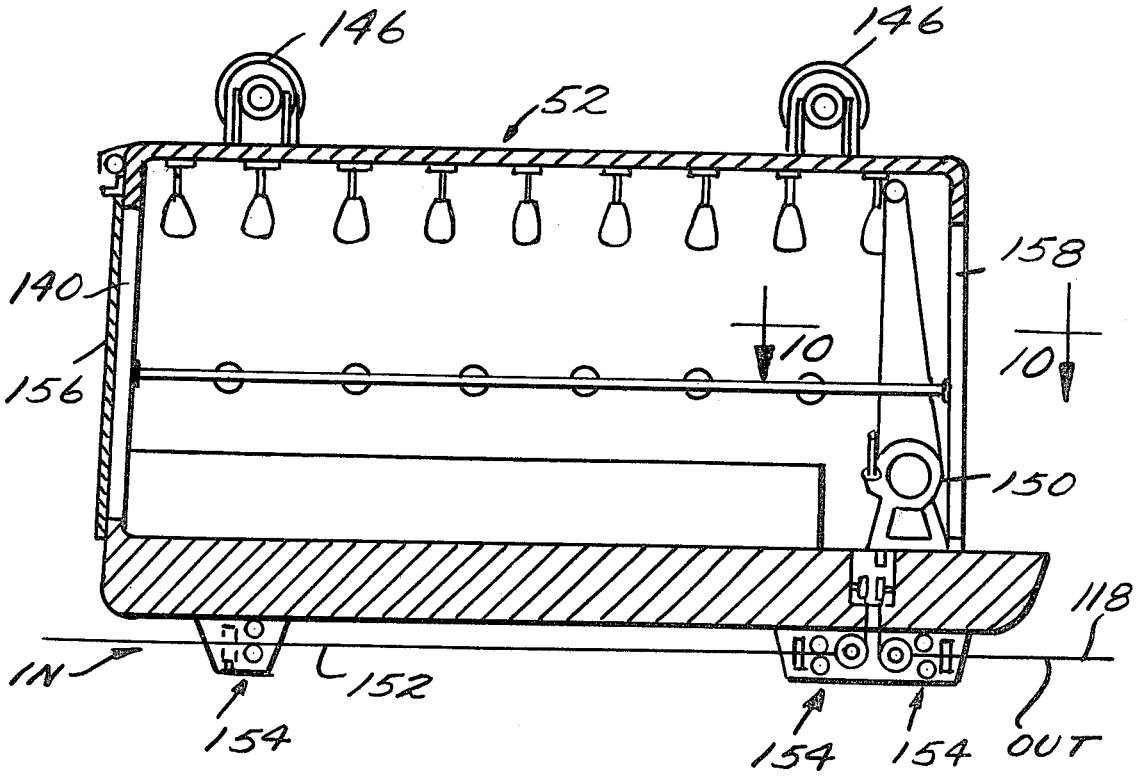
FIG. 9 is a vertical sectional view taken on line 9—9 of FIG. 8.

The personnel carrier 52 suspended on the cable of each cableway 50 is generally of the same construction and configuration as that shown and described in our aforementioned copending application. As shown in FIGS. 8–10, such carrier 52 has only two suspending sheaves 146 secured on the top, and spaced longitudinally along the center line thereof. Preferably, the carrier 52 is provided with outhaul and inhaul winches 148 and 150, respectively, for outhaul and inhaul lines 118 and 152, respectively, having their ends respectively fastened to the haven 44 and the platform 30 and extending through fairleads 154 beneath the carrier. As disclosed in our aforementioned copending application, the platform 30 end of each carrier 52 has a doorway 140 coverable by a roll-up fire-resistant curtain or door 156 and an open doorway 158 at its haven-end. The platform end desirably also is covered with fire-resistant material.

For installation of the system, the haven 44 may be towed to its operative position by a tug (not shown). To reduce towing resistance, the structures 56 may be deballasted, by pumping water from the ballast tanks 64, until the haven 44 floats with the larger cylinder 74 out of the water and the haven is supported only by the buoyancy of the smaller cylinders 58. During such tow the carrier 52 and cables for the cableways 50 may be carried on the haven 44. On arrival at the operative site, the structures 56 are ballasted to partially submerge the larger cylinders 74 approximately to the waterline mentioned heretofore to provide greatly increased stability in heavy seas. The haven 44 is then correctly oriented with respect to the platform 30 and anchored in place. The cableways 50 and inhaul lines 152 may be run to the platform 30 by the towing tug and the inhaul lines wound up by the winches 150 to pull the carriers 52 to the platform stations 130 where they are detachably secured in place by appropriate mechanisms (not shown). The carriers 52 are used to evacuate personnel from the platform by the procedure described in our aforementioned copending application.

Referring now to FIGS. 11–16 of the drawings, there are shown modifications of some of the improvements illustrated in FIGS. 1–10 described heretofore. The overall system includes, as heretofore, an offshore marine platform 160, a haven 162 anchored near but at a safe distance from the platform, and single-cable cableways 164, each traversable by a personnel carrier 166, extending downwardly from the platform to the haven. In this system, however, there are fewer cableways and carriers—three rather than four—than in the system illustrated in FIGS. 1–10, and the carriers 166 are designed to land in the sea adjacent to, rather than on, the haven 162. Consequently, the haven 162 may be much smaller than that illustrated in FIGS. 1–10, with resulting economies. For obvious reasons the system illustrated in FIGS. 11–16 is adapted for use in locations where heavy seas are not expected because the smaller haven 162, though stable, is not as stable as the larger haven 44 and because the carriers 166 will be afloat as they approach the haven 162.

The haven 162 comprises a single ballastable structure 168 similar to the aforedescribed structure 56. As best shown in FIGS. 13–16 of the drawings, the haven 162 includes a single upright buoyant cylinder 170 having, for example, a diameter of the order of 12 feet and a height of about 20 feet. At its lower end, the cylinder 170 has a ballast tank 172, like that disclosed with reference to FIGS. 1–10, provided with a suitable sea-valve (not shown) and a dewatering pump 174. Enclosing the upper end of the cylinder 170 is a rectangular box-like structure 176 having flat sides 178 of the order of 20 feet in length and 12 feet in height and a flat top which forms part of a weather deck 180. The structure 176 is secured and sealed to the upper end portion of the cylinder 170 by a flat rectangular bottom plate 182 pierced by a central circular aperture through which the cylinder extends, and by a similar plate 184 secured to the upper end of the cylinder above the bottom plate. As in the structures 56, the cylinder 170 and the box-like structure 176 together define a structure 168 that is ballastable to partially submerge the box-like structure to a depth, for example, of the order of $5\frac{1}{2}$ feet, with a freeboard of about $6\frac{1}{2}$ feet, when the haven 162 is in operative position. The top of the cylinder 170 desirably is covered by a deck 186, e.g. a grating having a hatch 188, so that the box-like structure 176, the plate 184 and the deck 184 form an interior compartment 190 suitable for housing machinery, the same as the compartment 82 in the structures 56. Access to the compartment 190 may be had in the same way as in the structures 56, i.e., by a stairway from a booby hatch on the weather deck 180. Since the weather deck space of the haven 162 and its free board are, however, considerably less than those of the haven 44, the mooring winches 192 desirably are located within the machinery compartment 190 with fairleads 194 on the deck 180 for the mooring lines 196. Further in the case of the haven 162, reliance may be had on the cableways 164 for anchoring purposes, rather than on anchors and mooring lines streamed toward the platform 30 as shown in FIGS. 1 and 2.

While the cylinder 170 and box-like structure 176, together define a ballastable structure 168 that is stable when in operative position, for even greater stability and to enlarge the weather deck 180 of the haven 162, it is desirable that the box-like structure be elongated in the direction of the cableways 164 with water-tight prow-like pointed end structures 198 to form a buoyant pontoon 200.

Mounted transversely of and above the weather deck 180, at a height, for example, of about 17 feet above water level, by uprights 202 and braces 204 is a transverse, horizontal beam 206 to which the ends of the cables of the three cableways 164 are attached. The ends of the outhaul cables 280 can be attached to suitable pads 210 on the weather deck 180. Desirably, the weather deck 180 is extended beyond the pointed aft end of the pontoon 200, by appropriate supporting beams 212 and plating, to form a boat landing having bumpers 214. Since, in the system shown in FIGS. 11 and 12, the carriers 166 are adapted to land in the sea, the haven 162 is equipped with a boarding net 216 that is secured to the edge of the weather deck 180 and draped over an outwardly and downwardly inclined supporting structure formed by brackets 218 that extend to about water level from the forward end of the haven and along its sides and have their lower ends connected by a horizontal pipe-like element 220. Thus, personnel disembarking from a carrier 166 afloat in the sea may easily clamber up the net 216 to the weather deck 180.

Referring now to FIGS. 17–20 of the drawings, there is shown a personnel carrier 166 especially adapted for use in a system incorporating a haven 162 of the type shown in FIGS. 11–16. The carrier 166 is similar to the carrier 52 in that it is of double-walled construction with the hollows filled with flotation material 222, e.g., buoyant cellular material, and has longitudinally-spaced suspending sheaves 224 attached to the top along the center line of the carrier. The carrier 166 is, however, preferably provided with a watertight cabin 226 having a single doorway 228 and a watertight door 230 at its platform end, water-tight port holes or windows 232 along its sides and at its haven end, and an escape hatch with a watertight cover 234 in its top. A braking inhaul-winch 236 desirably is provided within and at one side of the cabin 226 adjacent the doorway 228 and has an in-haul line 238 wound thereon which has its other end attached to the platform 160. In the forward end of the cabin 226 is an outhaul winch 240 having a line 242 wound thereon which has its other end attached to the haven 162, e.g., to a deck pad 244. Suitable fairleads 246 for the lines 238, 242 are provided beneath the ends of the carrier 166.

The cabin 226 may be provided with transverse rows of seats 248 on opposite sides of a center aisle for accommodating about two dozen people.

As mentioned before, the carrier 166 is designed to land in the sea so that it is buoyant and watertight. Desirably, the carrier 166 also is designed to be self-propelled and so is shaped somewhat like a vessel with the haven end convexly rounded both horizontally and vertically so as to form a bow 250. Below the platform end doorway 228 is a support 252 for an outboard motor normally covered by a step pad 254 hinged to the platform end of the carrier 166 so as to be pivotable up to uncover the support. Preferably an outboard motor 256 is stowed in a corner of the platform end of the cabin 226 and is attachable, as needed, to the support 252 to propel the carrier 166 when afloat.

Figure 11:
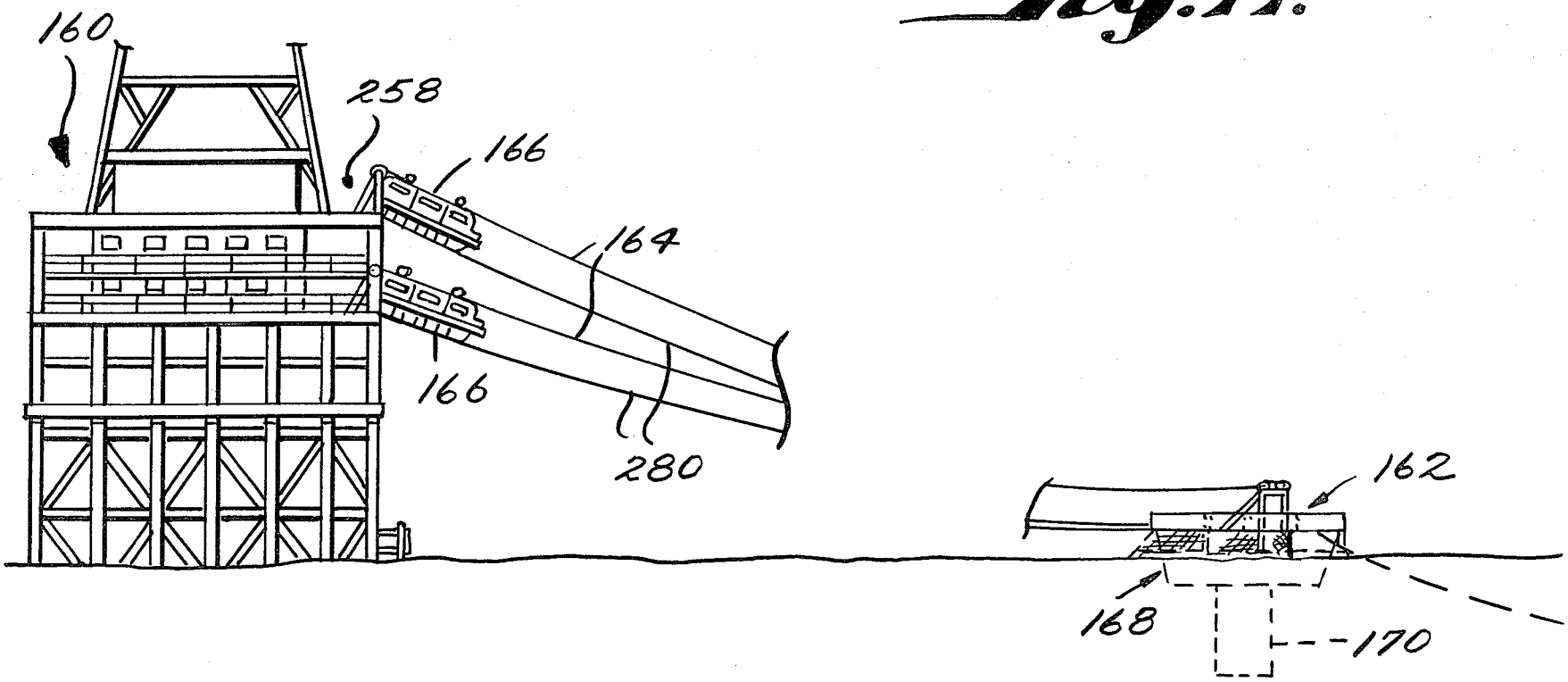
FIG. 11 is a view corresponding to FIG. 1 showing an improved system embodying a modified type of haven and personnel carrier.
Figure 12:
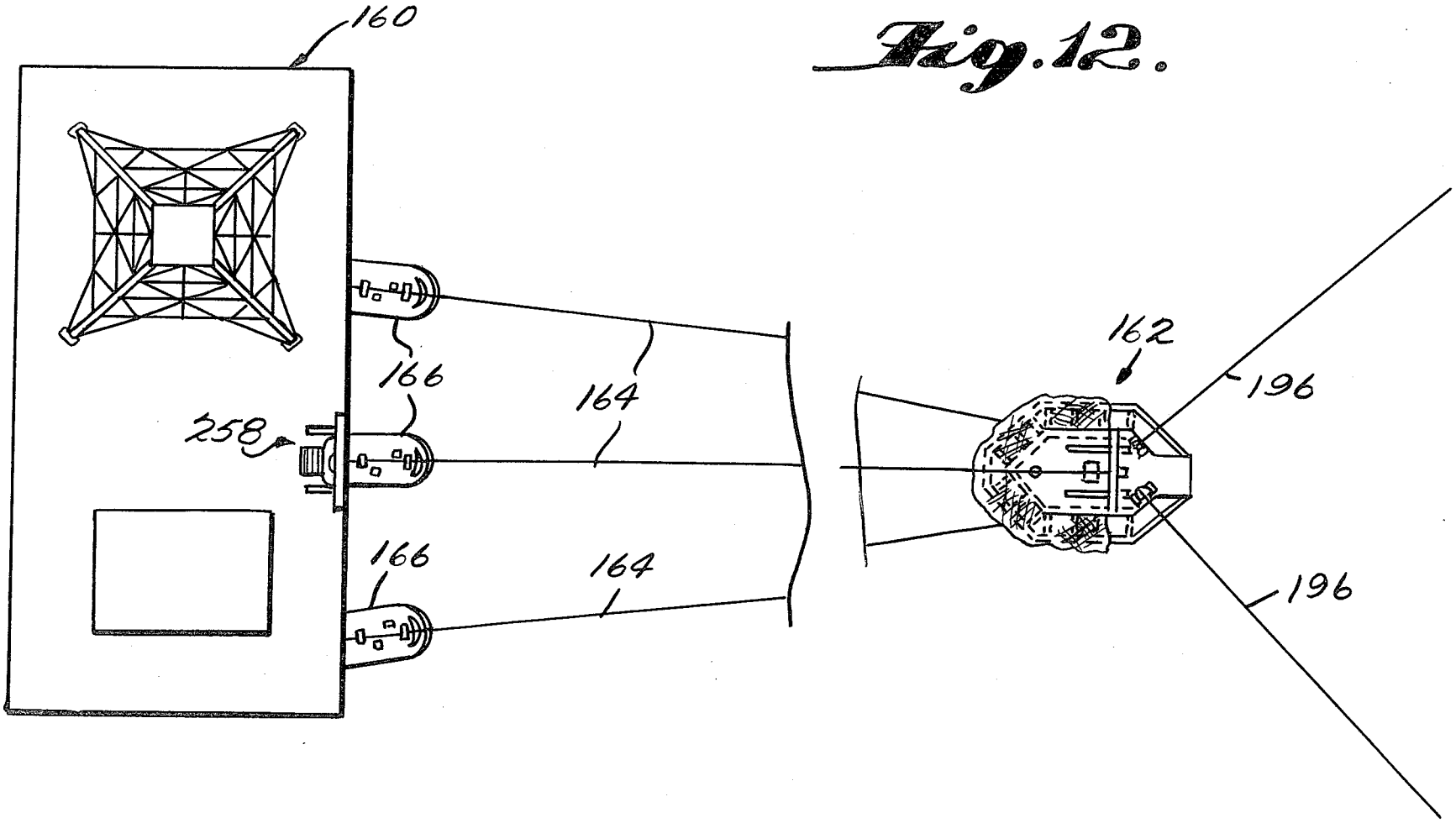
FIG. 12 is a plan view of the system shown in FIG. 11.
Figure 13:
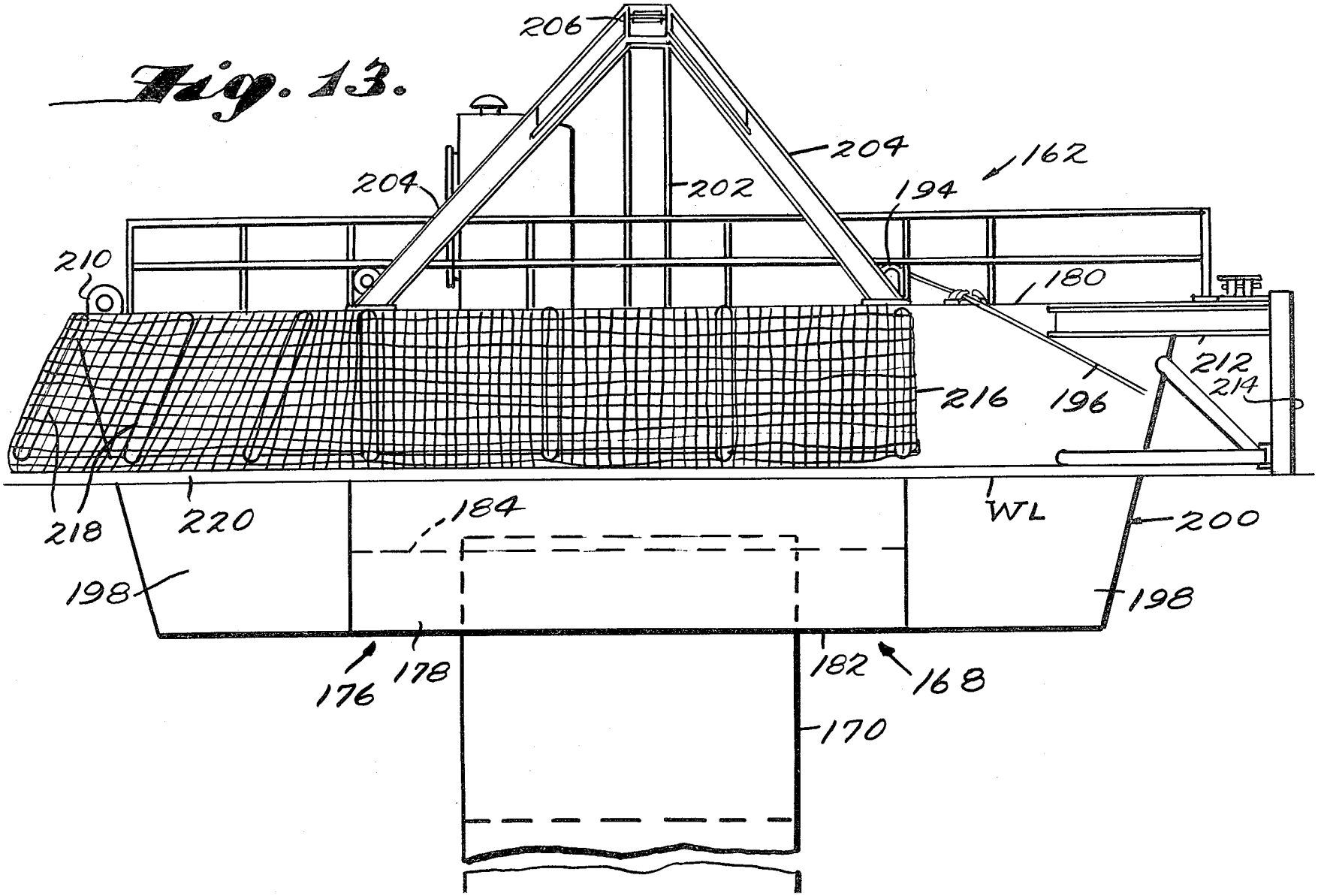
FIG. 13 is an enlarged view of the haven shown in FIG. 11 with the boarding net omitted for clarity.
Figure 17:
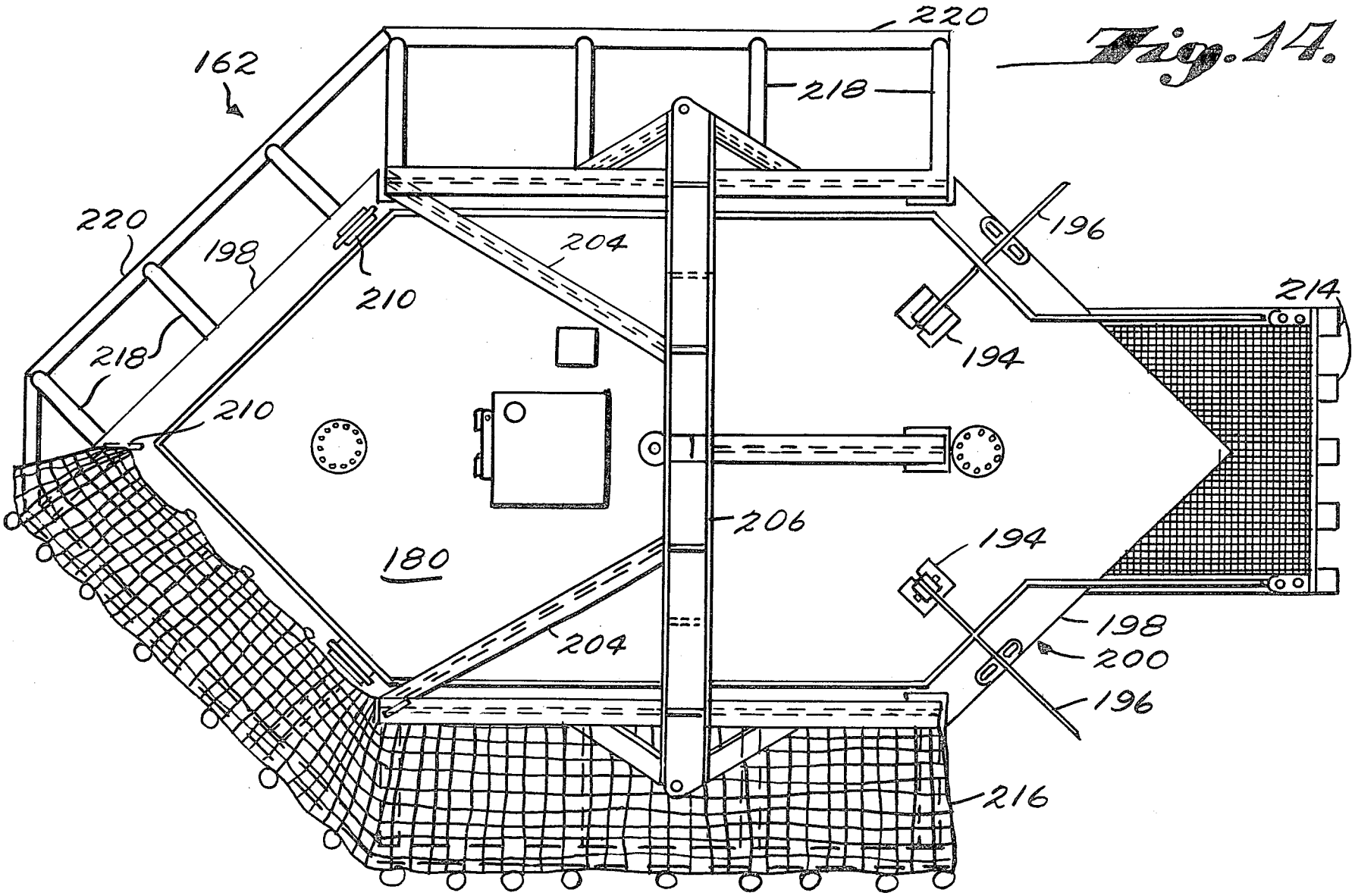
FIG. 17 is an enlarged top view of one of the carriers shown in FIG. 11.
Figure 15:
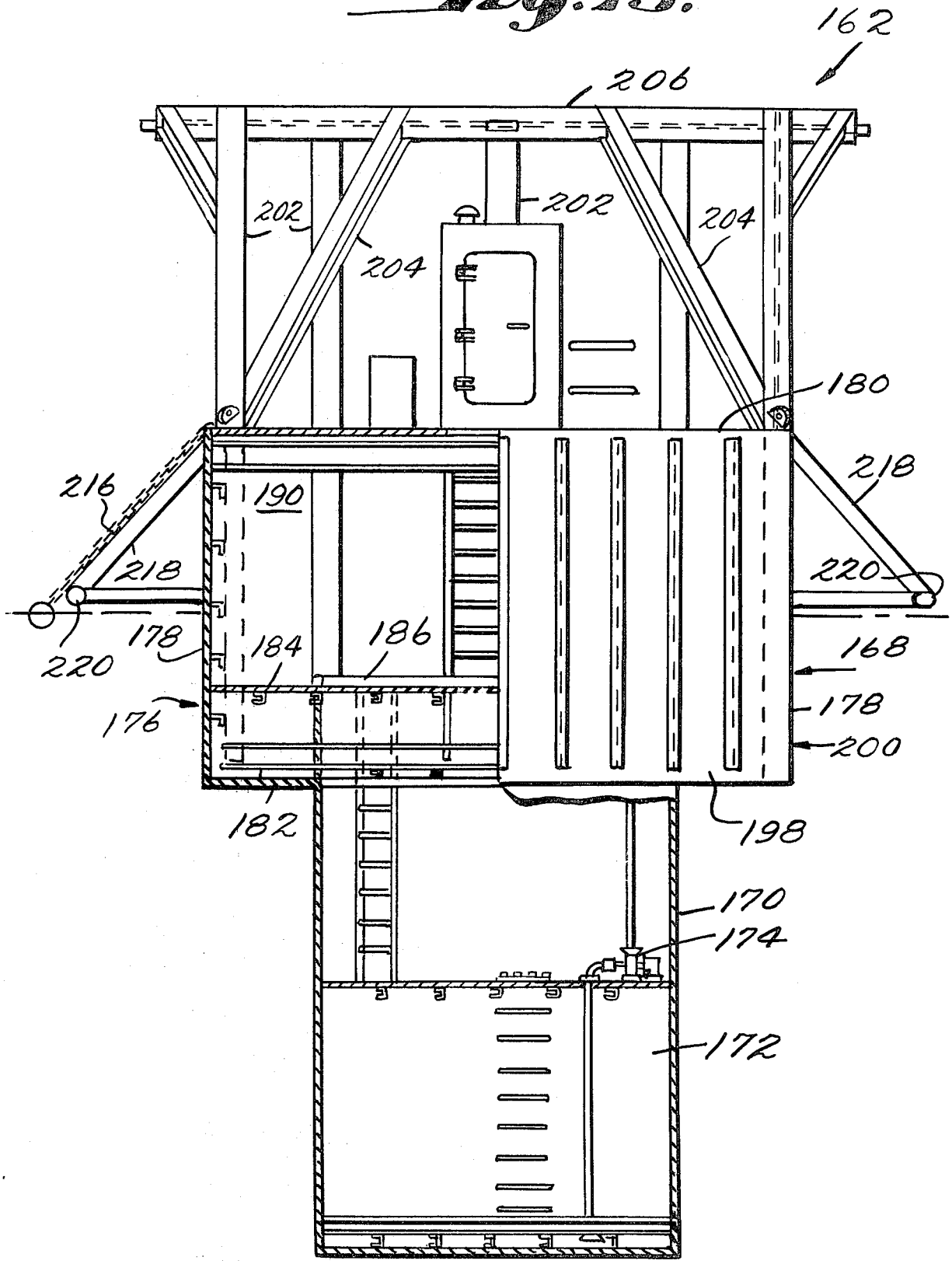
FIG. 15 is a view of the haven shown in FIG. 13 taken from the left side thereof with portions being shown in vertical section.
Figure 16:
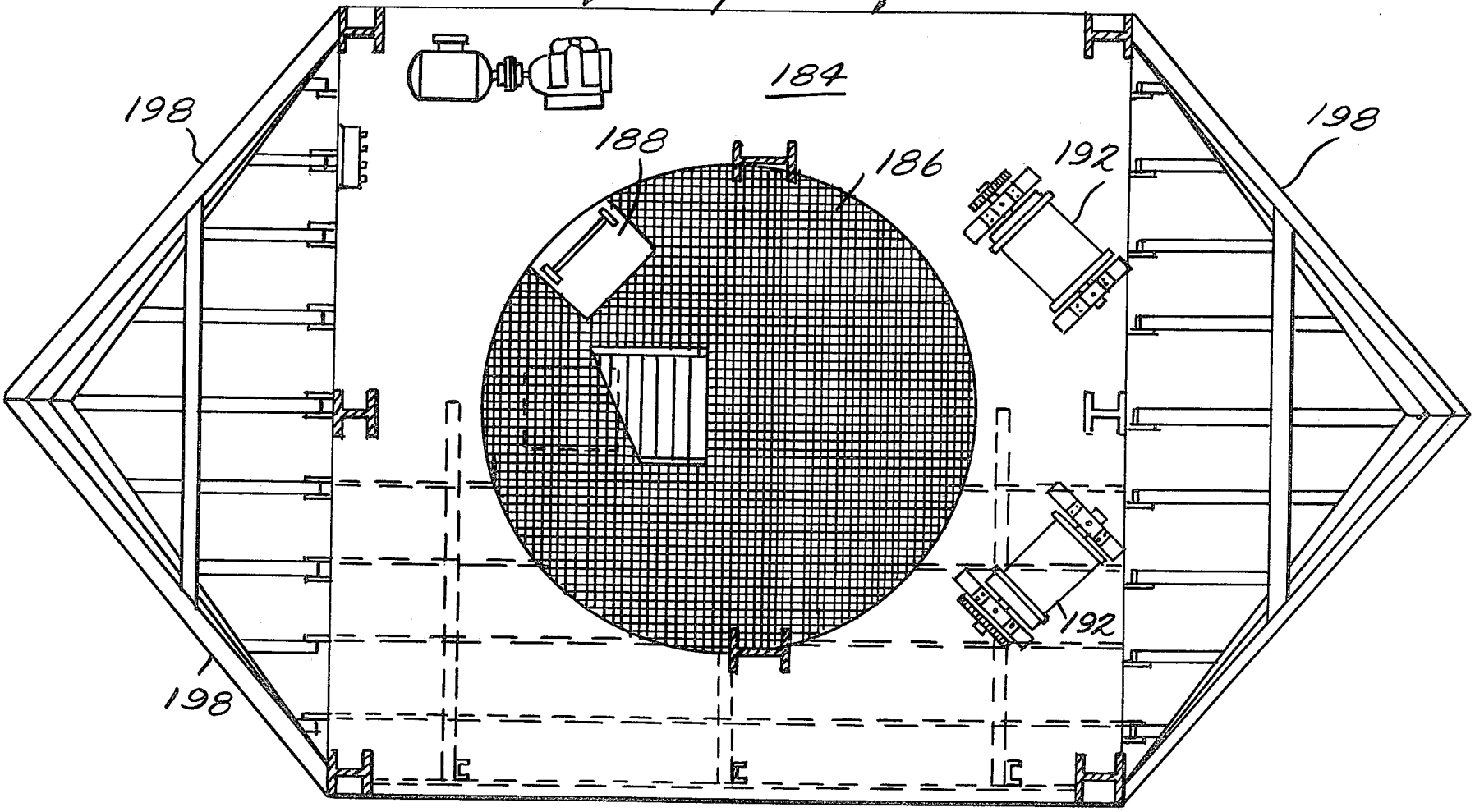
FIG. 16 is a horizontal sectional view taken on the water line shown in FIG. 13.
Figure 17:
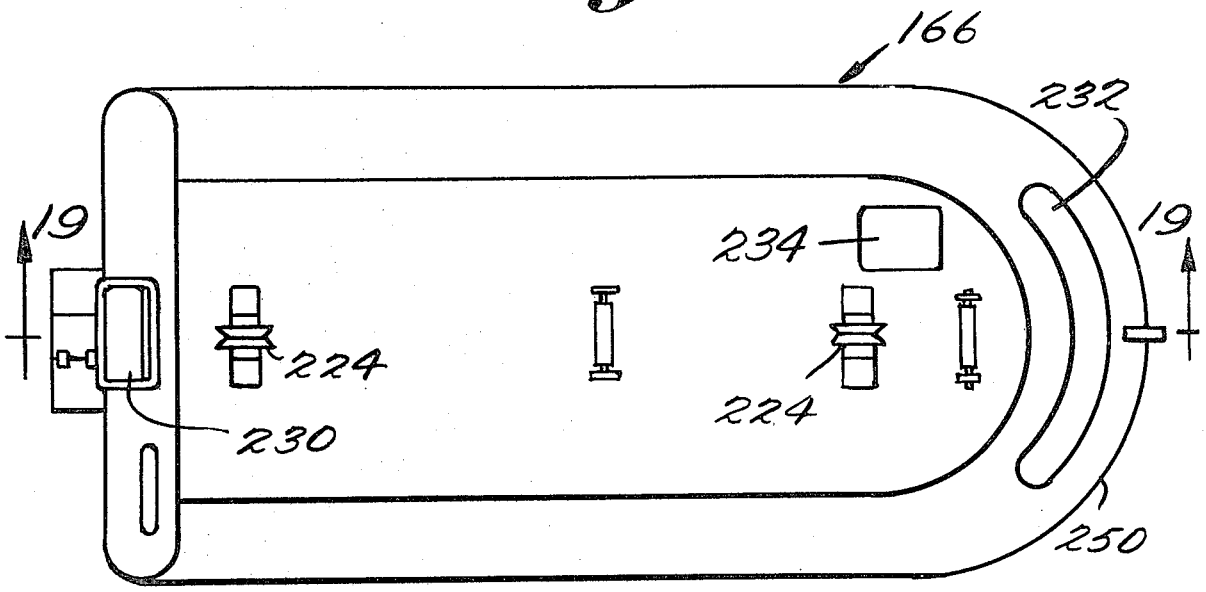
Figure 18:
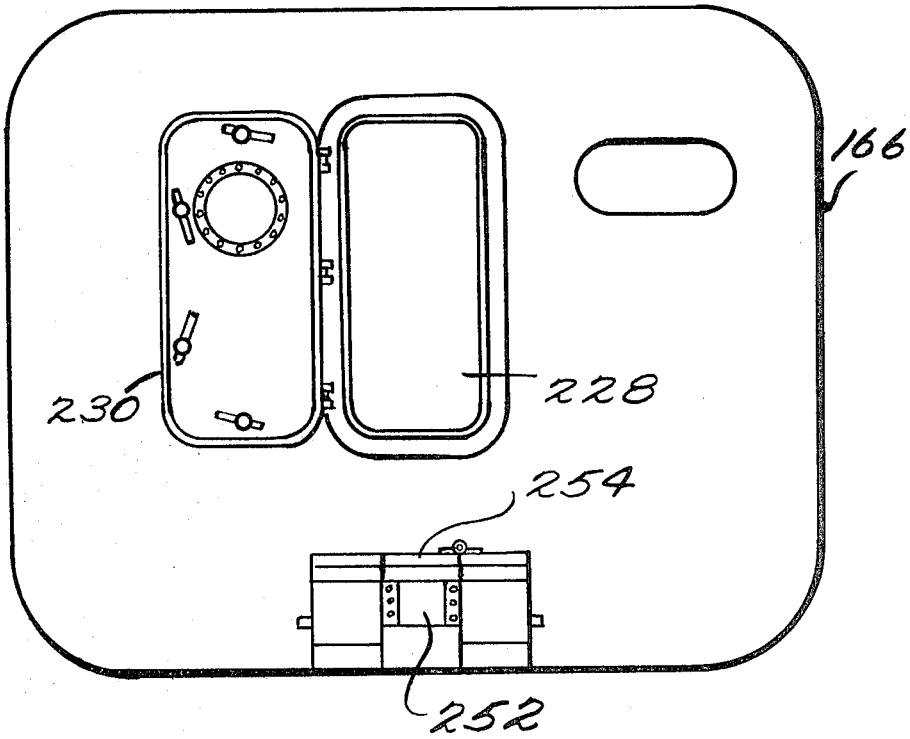
FIG. 18 is an end view of the carrier shown in FIG. 17 taken from the left side thereof.
Figure 19:
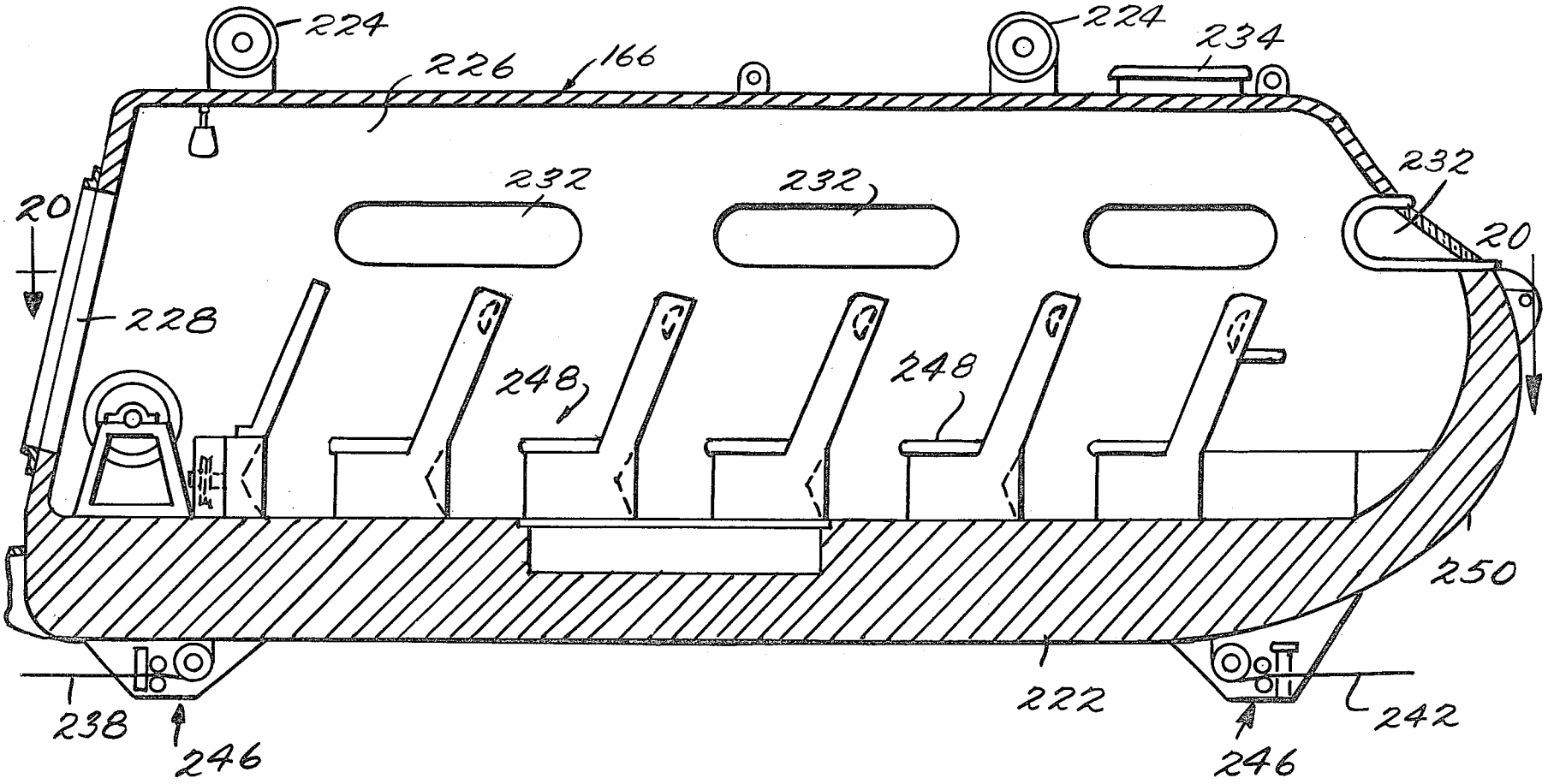
FIG. 19 is a sectional view taken on line 19—19 of FIG. 17.
Figure 20:
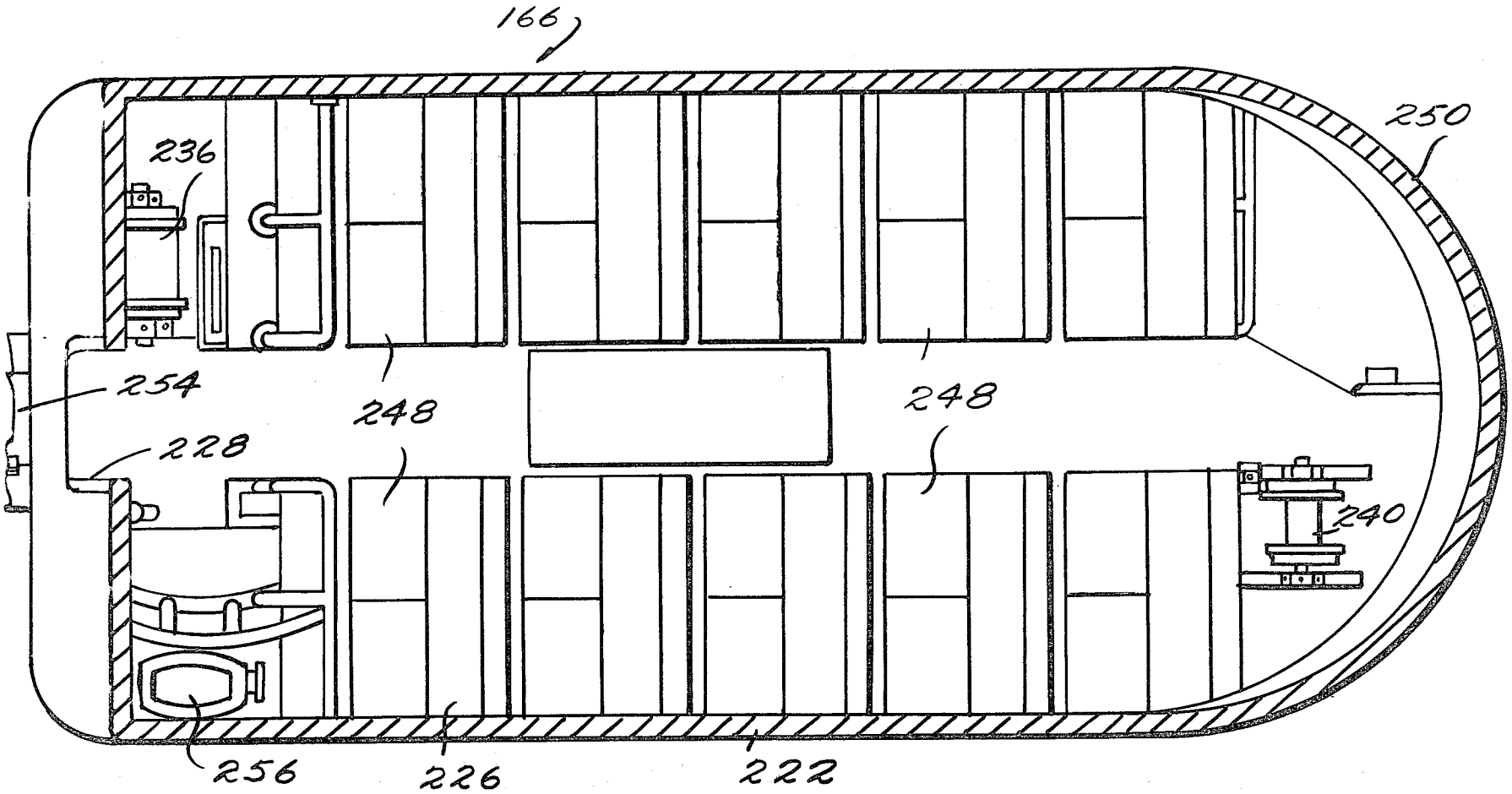
FIG. 20 is a sectional view taken on line 20—20 of FIG. 19.

For installation of the system shown in FIGS. 11 and 12, the haven 162, and also the carrier 166, may be towed, as by a tug (not shown) to the operative site. As in the case of the haven 44, the haven 162 may be deballasted by pumping water from the tank 172 until the pontoon 200 is above water in order to reduce towing resistance. Such deballasting is not essential, however, because the pointed ends 198 of the pontoon 200 greatly reduce towing resistance when the pontoon is partially submerged. At the site, the haven 162 is correctly oriented and moored, the cableways 164 installed, and the carriers 166 secured at their platform stations 258, as described above with respect to the larger haven 44.

Thereafter the boarding net 216 may be attached to the edge of the haven weather deck 180 and draped over its supporting structure 218, 220 as described above.

In an emergency situation, personnel board a carrier 166, seal the watertight door 230, release the carrier-securing mechanism (not shown) and allow the carrier to descent its cableway 164 by gravity at a speed controlled by braking the inhaul winch 236. The carrier 166 will land in the water and float therein near the haven 162, for example, about 50 feet away. If the sea is relatively calm, personnel on the haven 162 detach the end of the cableway 164 for the carrier 166 from the beam 206, and the end of the carrier outhaul line 242 from the deck pad 244, and the latter line is wound up on its outhaul winch 240. The inhaul line 238 may then be cut by the operator of the carrier 166 so as to leave the latter free to be propelled by the motor 256 without obstruction or interference from either of the inhaul and outhaul lines. The motor 256 can then be attached to the support 252 and operated to propel the floating carrier 166 to the boat landing on the haven 162 where the personnel in the carrier may disembark.

In the event, however, of a landing in rough seas, the foregoing procedure may be followed up to the point of propelling the carrier 166 toward the haven 162. At that time the carrier 166 is maneuvered to be as close to the haven 162 as possible without the danger of the seas knocking the carrier against the haven. The personnel can then disembark into the water, swim a short distance to the haven 162 and climb aboard via the boarding net 216. In the alternative after the sea landing the outhaul winch 240 simply is operated to pull the carrier 166 as close as possible to the haven 162, as in using the motor 256, and the personnel disembark and swim to the haven as before.

It thus will be seen that the objects and advantages of this invention have been fully and effectively achieved. It will be realized, however, that the specific embodiments disclosed herein are susceptible of modification without departing from the principles of the invention. Accordingly, the invention encompasses all embodiments falling within the spirit and scope of the following claims.

I claim:

1. In a system for escaping from an offshore drilling or production platform, or the like, in emergency situations which includes an offshore platform in operative position substantially fixed relative to the marine bottom at an offshore location for engaging in hazardous operations involving combustible and explosive fluids entrapped in the marine bottom, a floating haven fixedly anchored near but at a safe distance from the platform, at least one cableway unsupported between its ends attached to and extending above water between the platform and the haven with the cableway inclining downwardly from the platform to the haven, and a personnel carrier suspended from and movable along the cableway for transferring personnel from the platform to the haven, the improvement wherein the haven comprises:

at least one upright buoyant cylinder;

means for ballasting and deballasting said cylinder;

means defining an enlarged watertight compartment mounted to the upper end of said cylinder with the top of said compartment forming a weather deck, said cylinder and said compartment-defining means together forming a structure ballastable to float with said compartment partly submerged for increased stability.

2. In the system defined in claim 1, the further improvement of means mounted to the platform for adjusting the tension in the cableway to maintain it above water.

3. In the system defined in claim 1 the further improvement of the cableway comprising a single cable.

4. In the system defined in claim 1 the further improvement of the haven comprising:

three ballastable structures arranged in generally equi-spaced relation; and trusswork rigidly connected said structures above the water line when ballasted to float with the compartments partly submerged.

5. In the system defined in claim 4 the further improvement comprising a walkway connecting at least two of the structures below the weather decks thereof and above the water line to form a boat landing.

6. In the system defined in claim 4 the further improvement comprising:

a personnel carrier landing deck; and means mounting said landing deck above and extending to and between the weather decks of two of the structures.

7. In the system defined in claim 1 the further improvement of the compartment being horizontally elongated and forming a pontoon having generally prow-like pointed ends substantially aligned with the cableway.

8. In the system defined in claim 7, the further improvement comprising:

the cableway being secured to the haven at a height so that the personnel carrier lands in the water a short distance in advance of the haven, the personnel carrier being buoyant and having an enclosed personnel cabin provided with watertight closures, and including boarding nets draped about at least that one end of the pontoon facing the platform.

9. In the system defined in claim 1, the further improvement comprising:

the cableway being secured to the haven at a height so that the personnel carrier lands in the water a short distance in advance of the haven, the personnel carrier being buoyant, having an enclosed personnel cabin provided with watertight closures, and being adapted to be propelled in the water by a detachable outboard motor, and an outboard motor carried in the carrier and adapted to be mounted thereto for propelling the carrier in the water.

10. An apparatus for use in escaping from an offshore platform in emergency situations while such platform is in an operative position substantially fixed relative to the marine bottom at an offshore location for engaging in hazardous operations involving combustible and explosive fluids entrapped in the marine bottom which includes a floating haven adapted to be anchored near but at a safe distance from the platform, at least one cableway adapted to be connected to and to extend above water between the platform and the haven, and a personnel carrier adapted to be suspended from and to be movable along the cableway when the latter is so connected, the improvement of the haven comprising:

at least one upright buoyant cylinder;

means for ballasting and deballasting said cylinder; and means defining an enlarged watertight compartment mounted to the upper end of said cylinder with the top of said compartment forming a weather deck, said cylinder and said compartment-defining means together forming a structure ballastable to float with said compartment partly submerged for increased stability.

11. The improvement defined in claim 10 wherein haven comprises:

three ballastable structures arranged in generally equi-spaced relation; and trusswork rigidly connecting said structures above the water line when ballasted to float with the compartments partly submerged.

12. The improvement defined in claim 11 including a walkway connecting at least two of the structures below the weather decks thereof and above the water line to form a boat landing.

13. The improvement defined in claim 10 wherein the haven comprises a single ballastable structure with the compartment being horizontally elongated and forming a pontoon having generally prow-like pointed ends adapted to be aligned generally with the cableway.

14. A personnel carrier for use in a system for escaping from an offshore platform in emergency situations while such platform is in an operative position substantially fixed relative to the marine bottom at an offshore location for engaging in hazardous operations involving explosive and combustible fluids entrapped in the marine bottom which includes a floating haven anchored near but at a safe distance from the platform and at least one cableway connected to and extending above water between the platform and the haven, said carrier comprising:

a buoyant structure forming an elongated personnelaccommodating cabin provided with a doorway in at least one end thereof;

sheaves secured to the top of said structure for stably suspending said carrier from and for travel along, a cableway connected to and extending above water between an offshore platform and a floating haven, an outhaul winch in said cabin having a cable wound thereon, one end of said cable being adapted to be fastened to the haven; and an inhaul winch in said cabin having a cable wound thereon, one end of said cable being adapted to be fastened to the platform.

15. The carrier defined in claim 14 including fairleads for the cables beneath the cabin.

16. The carrier defined in claim 14 in which the doorway is adapted to face the platform and including a fire-resistant material covering the said end of the carrier.

17. The carrier defined in claim 14 in which the structure is adapted to land in the water and to be self-propelled therein, wherein the cabin is watertight and including:

a watertight door for the doorway; and an outboard motor carried in the cabin and adapted to be attached to said structure at one end thereof for propelling the same in the water.

* * * * *